United States Patent [19]

Pringle

[11] Patent Number: 4,982,874

[45] Date of Patent: Jan. 8, 1991

[54] SHAMPOO DISPENSING CONTAINER

[76] Inventor: William Pringle, 2769 Hidden Oak Dr., Johns Island, S.C. 29455

[21] Appl. No.: 462,736

[22] Filed: Jan. 8, 1990

[51] Int. Cl.[5] ..... B67D 1/04

[52] U.S. Cl. ..... 222/78; 222/209; 222/211; 222/215; 222/401; 222/464; 446/475

[58] Field of Search ..... 222/78, 209, 211, 215, 222/382, 464, 505; 221/24; 446/475

[56] References Cited

U.S. PATENT DOCUMENTS 3,143,755 8/1964 Rowley .

3,388,835 6/1968 Naughten .

4,286,407 9/1981 Adickes, Jr. et al. ..... 222/78

4,630,756 12/1986 Amici .

*Primary Examiner*—Andres Kashnikow

*Assistant Examiner*—Philippe Derakshani

*Attorney, Agent, or Firm*—Terry M. Gernstein

[57] ABSTRACT

A shampoo dispensing container is in the shape of an action figure, such as an army figure, and has a fluid pumping system that operates to dispense shampoo from the container in an exploding type pattern as one of the arms of the action figure is operated in a combat type movement.

2 Claims, 3 Drawing Sheets

SHAMPOO DISPENSING CONTAINER

TECHNICAL FIELD OF THE INVENTION

The present invention relates to the general art of containers, and to the particular field of liquid dispensing containers.

BACKGROUND OF THE INVENTION

It is often difficult to persuade young children to use shampoo on their hair when they are bathing.

While there are numerous shampoo dispensing containers presently available, most of these containers are in a generally cylindrical form, or are bottles or the like. Such containers are efficient in storing and dispensing shampoo and in providing area on which logos, advertising or ingredient information can be placed. However, such containers, while efficient, do not really appeal to young children. Most of the time, children do not even notice what type of container is being used.

Since children represent a very strong and large segment of the purchasing public, presently available shampoo dispenser are missing a large portion of the market by not appealing to young children.

Therefore, there is a need for a shampoo dispensing container which will appeal to young children, yet will still efficiently dispense shampoo, especially in a manner that will enhance the appeal to such children.

OBJECTS OF THE INVENTION

It is a main object of the present invention is to provide a shampoo dispensing container which will appeal to young children.

It is another object of the present invention to provide a shampoo dispensing container which will appeal to young children, yet will still efficiently dispense shampoo.

It is another object of the present invention to provide a shampoo dispensing container which will appeal to young children, yet will still efficiently dispense shampoo, especially in a manner that will enhance the appeal to such children.

SUMMARY OF THE INVENTION

These, and other, objects are achieved by a shampoo dispensing container that is in the shape of an action figure. Such action figures can be combat soldiers, ninjas, or like human form figures. The figure includes a dispensing nozzle mounted in one hand and a movable arm. The movable arm is moved in a combat action manner to force shampoo out of the nozzle in an exploding effect. Both of these features enhance the action nature of the figure thereby enhancing the appeal thereof to young children.

BRIEF DESCRIPTION OF THE DRAWING FIGURES

DETAILED DESCRIPTION OF THE PREFERRED EMBODIMENT OF THE INVENTION

Figure 1:
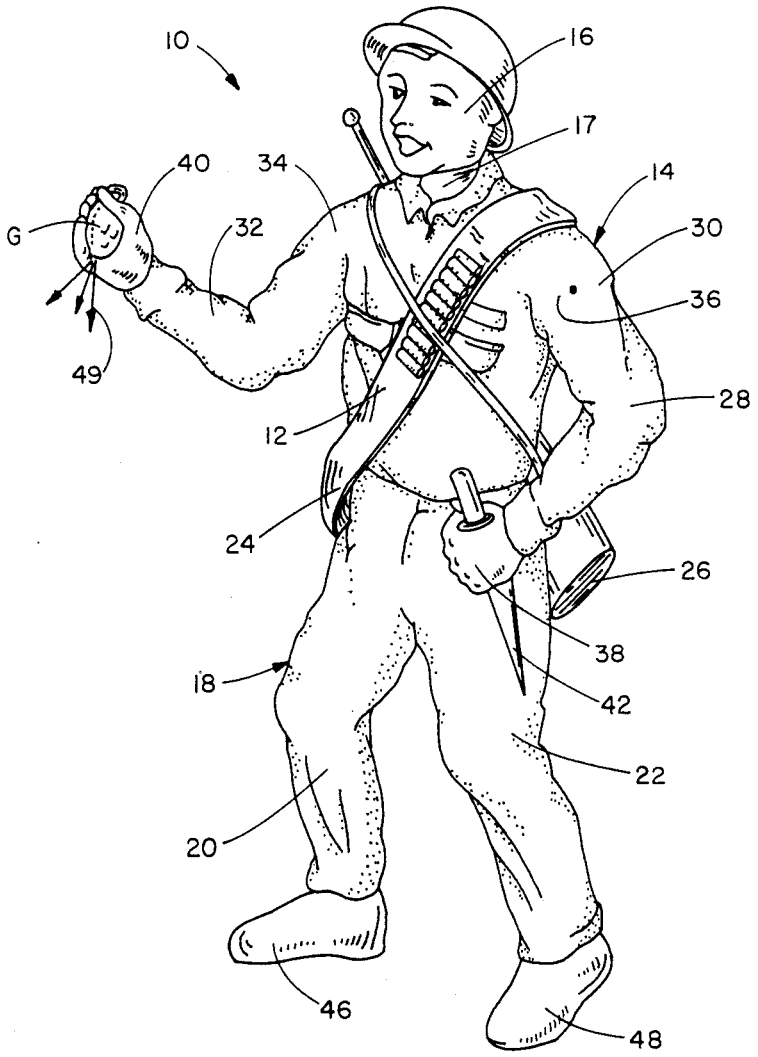
FIG. 1 is a perspective of an action figure shampoo dispensing container embodying the present invention in a shampoo dispensing position.

Shown in FIG. 1 is a human form action figure container 10 for containing and dispensing shampoo in a manner that will appeal to young children. The container 10 is in the form of a combat soldier, and includes a trunk section 12 which has a shoulder and head section 14 on which a head 16 and neck 17 are surmounted, and a leg section 18 on which first and second legs 20 and 22 are attached. Suitable adornments, such as a bandoleer 24 and a rifle 26 are also attached to the trunk section.

The action figure also has first arm 28 attached at a shoulder portion 30 to the trunk and a second arm 32 attached at a shoulder portion 34 to the trunk. Each shoulder portion includes a section corresponding to the deltoid section of a human arm, such as deltoid section 36 of the first arm 28. A first hand 38 is attached to the first arm 28 and a second hand 40 is attached to the second arm 32. A first weapon, such as a knife 42, is held in the first hand, and a second weapon, such as a hand grenade 44, is held in the second hand. Both of the weapons are held in a "ready" position. The action figure also has a first foot 46 attached to the first leg 20 and a second foot 48 attached to the second leg 22, and the feet are arranged so that the container can rest on the feet in the position shown in FIG. 1.

Figure 2:
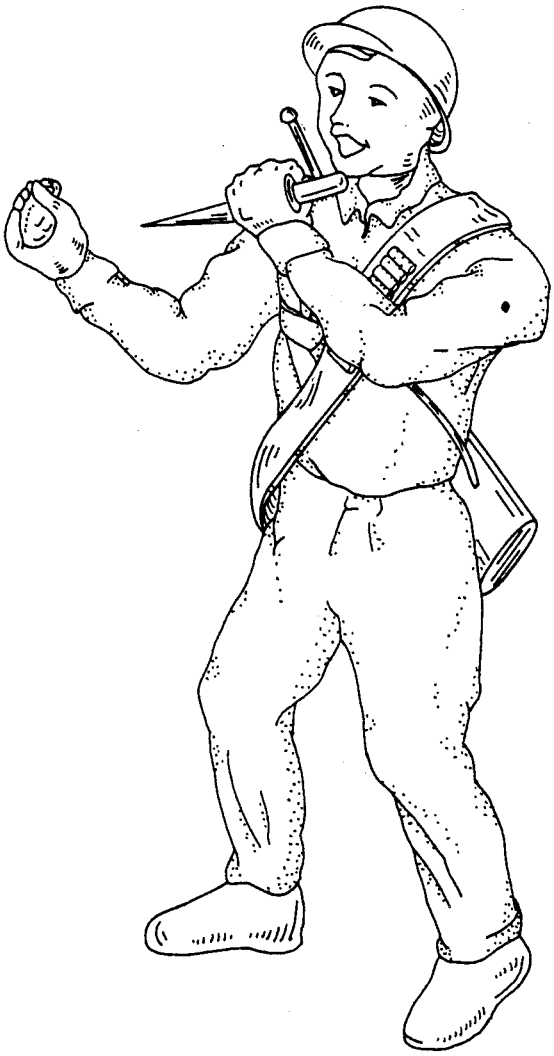
FIG. 2 is a perspective view of the action figure in an air intake position.

Liquid shampoo is stored in the container, and is dispensed therefrom by moving the first arm 28 up and down in a stabbing motion. This movement is seen by comparing FIGS. 1 and 2. Movement of the arm 28 from the FIG. 1 position to the FIG. 2 position will be termed the cocking movement, and movement from the FIG. 2 position back to the FIG. 1 position will be termed dispensing movement. The arm is moved between the cocked and the dispensing positions to dispense shampoo.

Shampoo is dispensed from a nozzle located in the bottom of the hand grenade G as indicated by spray 49 in FIG. 1. This spray produces an exploding effect that enhances the overall combat effect of the container.

Figure 3:
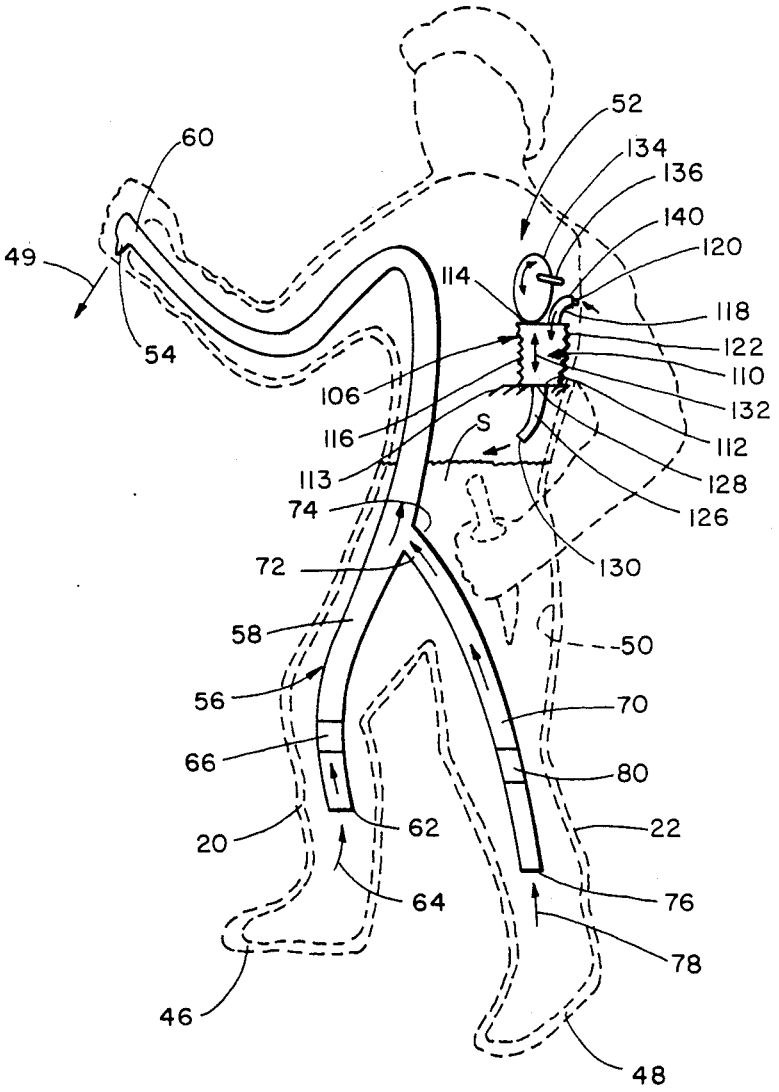
FIG. 3 is a schematic illustrating the fluid connections and fluid circuit associated with the action figure.

Referring to FIG. 3, it is seen that the container 10 is hollow, and has an air-tight liner 50 completely surrounding the entire inner surface of the container. Shampoo S is contained in the liner and is pumped out of the container by a shampoo dispensing assembly indicated generally by the reference numeral 52.

The dispensing assembly includes a dispensing nozzle 54 in the hand grenade that is held in the second hand 40 and a fluid conduit system 56 fluidically connecting the dispensing nozzle to the liquid shampoo.

The fluid conduit system includes a first fluid conduit 58 having an outlet 60 fluidically connected to the dispensing nozzle and an inlet 62 located in the first leg 20 near the first foot 46 to draw shampoo into the conduit 58 in the direction indicated by arrow 64. A first one-way valve 66 is located in the conduit 58 to ensure that shampoo flows only in the direction of arrow 64 towards the outlet and towards the dispensing nozzle.

The fluid conduit system further includes a second fluid conduit 70 having an outlet 72 fluidically connected to the first fluid conduit 58 at a Y-connection 74 and an inlet 76 located in the second leg 22 near the second foot 48. Shampoo is also drawn into this inlet 76 in the direction indicated by arrow 78, and a second one-way valve 80 is positioned in the second fluid conduit 70 to ensure that shampoo flows only from the inlet 76 towards the outlet 72, and not in the reverse direction.

Figure 4:
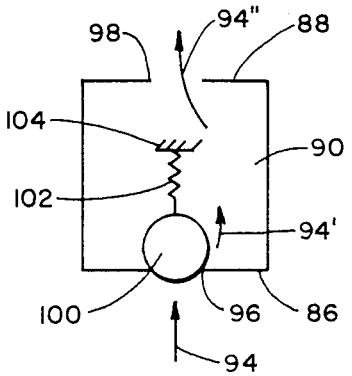
FIG. 4 is a one-way valve used in the action figure shampoo dispensing container.

A one-way valve is shown in FIG. 4, and includes a housing 84 that is attached to the inner surface of the fluid conduit, and has a forward end 86 and a rear end 88 that are spaced apart from each other to define a chamber 90 therebetween, with the forward and rear ends being defined according to the flow direction of shampoo through the valve as indicated in FIG. 4 by the arrow 94. The housing front end 86 is annular and has a central opening 96 defined therein, and the rear end also is annular to have a central opening 98 defined therein. A ball 100 is attached to a spring 102 that has one end attached to the ball and another end mounted on a support 104 located in the chamber 90. The spring 102 biases the ball into contact with the front end 86 adjacent to the front end central opening to occlude that opening. However, shampoo can flow through the one-way valve in the direction indicated by the arrows 94, 94' and 94" by moving the ball away from the central opening against the bias of the spring 102. However, flow in the reverse direction is prohibited by the ball engaging the front end adjacent to the central opening.

Referring again to FIG. 3, the shampoo dispensing assembly is seen to further include a compartment pressurizing system, generally indicated by the reference numeral 106. This compartment pressurizing system is used to pressurize the shampoo containing interior of the figure to force that shampoo into the inlets of the fluid conduits The pressurizing system is operated by the aforediscussed action of the arm 28 between a cocked position and a dispensing position.

The pressurizing system includes a bellows 110 mounted at one end 112 thereof on a platform 113 that is affixed to the action figure inner surface so that the end 112 is essentially immobile with respect to the action figure body. The bellows also contains a second end 114 that is connected to the one end 112 by a pleated body 116.

An air inlet conduit 118 has an inlet end 120 located to be in fluid communication with ambient air surrounding the container 10 and an air outlet 122 that is in fluid communication with the interior of the bellows whereby air can be drawn into the bellows. An air outlet conduit 126 has an inlet end 128 attached to the bellows to receive air from the interior of that bellows, and an air outlet end 130 that is located inside the air-tight liner.

Movement of the bellows in the direction of double-headed arrow 132 will draw ambient air into the bellows and force that air out of the bellows into the interior of the air-tight liner to pressurize the shampoo contained therein.

The bellows is operated by a cam 134 that is rotatably mounted on the container by an axle 136 that is fixedly connected to the arm 28 for movement therewith. The axle is located near the deltoid section of that arm so that the aforediscussed cocking and dispensing movements of the arm 28 will alternately compress the bellows and permit the natural resiliency of that bellows to cause recovery thereof. The cam is mounted in an offcenter manner on the axle and is shaped to compress the bellows when the arm is moved downwardly into the FIG. 1 position, and to permit recovery of the bellows when the arm is in the FIG. 2 cocked position.

Operation of the container is quite simple. Movement of the arm 28 from the FIG. 2 position to the FIG. 1 position moves the cam against the bellows and forces air into the liner to pressurize that liner and force shampoo into the conduits 58 and 70. Shampoo moves through these conduits and the flow is controlled by the one-way valves. Eventually, the shampoo is dispensed from the nozzle 54. A suitable one-way valve 140 is positioned in the air conduit 118 so that ambient air is drawn into the bellows but cannot return when the bellows recovers. This will permit the container to be pressurized once, and thereafter will not need to be re-pressurized for each use. The arm can be actuated one or two times to dispense the shampoo.

It is understood that while certain forms of the present invention have been illustrated and described herein, it is not to be limited to the specific forms or arrangements of parts described and shown.

I claim:

1. A dispensing container for shampoo comprising (A) a human form figure having a hollow body which includes
  (1) a trunk portion,
  (2) first and second legs attached to said trunk portion,
  (3) first and second feet attached to said first and second legs respectively,
  (4) first end second arms attached to said trunk portion,
  (5) first and second hands attached to said first and second arms respectively,
  (6) said first arm being rotatably connected to said trunk section to move from a cocked position to a shampoo dispensing position, and
  (7) a liner fixedly attached to an inner surface of said body to define an air-tight compartment within said body;

(B) liquid shampoo contained within said air-tight compartment;

(C) a shampoo dispensing assembly which includes
  (1) a dispensing nozzle mounted on said second hand:
  (2) a fluid conduit system fluidically connecting said dispensing nozzle to said liquid shampoo, said fluid conduit system including
    (a) a first fluid conduit having an outlet connected to said dispensing nozzle, an inlet located in said first leg near said first foot,
    (b) a first one-way fluid valve in said first fluid conduit and oriented to permit flow of said shampoo from said first fluid conduit inlet toward said first fluid conduit outlet,
    (c) a second fluid conduit having an outlet fluidically connected to said first fluid conduit at a location between said first one-way fluid valve and said first fluid conduit outlet and an inlet located in said second leo near said second foot,
    (d) a second one-way fluid valve in said second fluid conduit and oriented to permit flow of said shampoo from said second fluid conduit inlet toward said second fluid conduit outlet, and
    (e) a compartment pressurizing system which includes
      (i) a bellows mounted on said body inside said air-tight compartment and having an air conduit with an air inlet located outside of said body and an air outlet located inside said bellows to draw ambient air into said bellows, said bellows having a first end and a second end, (ii) a one-way air valve in said air conduit and being oriented to permit air to flow into said bellows in said air conduit but to prohibit air from flowing out of said bellows via said air conduit, (iii) a pivot pin mounted on said first arm for rotation therewith, (iv) a cam rotatably mounted on said pivot pin for rotation therewith to contact said bellows second end to compress said bellows in conjunction with said first arm moving from said cocked position to said dispensing position and to permit said bellows to recover as said first arm moves back from said dispensing position to said cocked position, and (v) an air outlet conduit having an inlet fluidically connected to said bellows second end to receive air from said bellows as said bellows is compressed and having an outlet located inside of said air-tight compartment to direct air from said bellows into said air-tight compartment to pressurize said air-tight compartment and to force shampoo into said first and second fluid conduits to move to said dispensing nozzle

2. The dispensing container declined in claim 1 wherein said body is in the shape of an army figure and further including a hand grenade located in said second hand with said dispensing nozzle being located in said hand grenade

* * * * *